United States Patent [19]

Montalto

[11] Patent Number: 4,507,808

[45] Date of Patent: Apr. 2, 1985

[54] METHOD OF MANUFACTURING CLOTHING

[76] Inventor: Antonelli Montalto, 48 Rues deBerry, Paris, France

[21] Appl. No.: 558,264

[22] Filed: Dec. 5, 1983

[30] Foreign Application Priority Data

Dec. 8, 1982 [FR] France ..... 82 20566

[51] Int. Cl.[3] ..... A41D 27/10; A41B 1/08

[52] U.S. Cl. ..... 2/243 B; 2/243 R; 2/125; 2/93

[58] Field of Search ..... 2/243 B, 243 R, 125, 2/122, 118, 115, 85, 93, 102; 33/11, 12, 17 R, 17 A

[56] References Cited

U.S. PATENT DOCUMENTS

| | | | |
|---|---|---|---|
| 1,965,995 | 7/1934 | Tripp | 2/93 |
| 2,179,675 | 11/1939 | Trageser | 2/93 |
| 2,426,818 | 9/1947 | Clyne | 2/93 |
| 2,438,171 | 3/1948 | Jamieson | 2/125 X |
| 2,836,826 | 6/1958 | Geiss | 2/125 |
| 2,886,821 | 5/1959 | Tomii | 2/243 R X |
| 3,719,956 | 3/1973 | Glassberg | 2/125 |
| 3,803,717 | 4/1974 | Mrak | 33/17 R |

*Primary Examiner*—Werner H. Schroeder
*Assistant Examiner*—Judith L. Kravitz
*Attorney, Agent, or Firm*—Kramer and Brufsky

[57] ABSTRACT

A method is provided for tracing, cutting and assembling a garment part with an upper portion having the outline of an armhole and a given width, along with a lower portion with a given width. The garment part is contained in a rectangle whose width is equal to the given width of the lower portion, with part of the outline of the armhole being eliminated. An auxiliary cut-out portion is provided in the lower part of the partial outline of the armhole, and an auxiliary panel is cut whose upper edge replaces the eliminated portion of the outline of the armhole. The auxiliary cut-out portion is opened and is held open by means of the auxiliary panel which is sewn to the edges of the auxiliary cut-out portion in order to provide a completed armhole with a useful width.

6 Claims, 13 Drawing Figures

METHOD OF MANUFACTURING CLOTHING

The invention relates to a method for tracing and cutting fabrics for the manufacture of clothing for the upper part of the body, such as jackets, overcoats, vests, etc. and also sleeves which are part of some of these garments.

The main purpose of the invention is to develop a tracing and cutting method which brings about considerable savings of fabric compared to the conventional method and a substantial reduction in sewing time.

To ensure that the invention is well understood, the following description reviews the conventional method of tracing and cutting a jacket and a sleeve.

Figure 1:
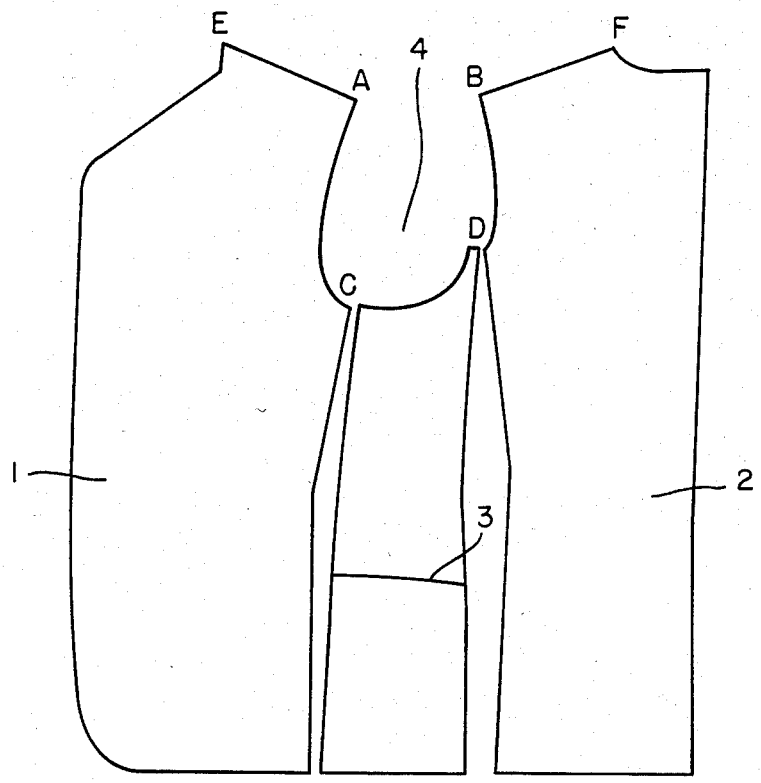
FIG. 1. PRIOR ART
Figure 2:
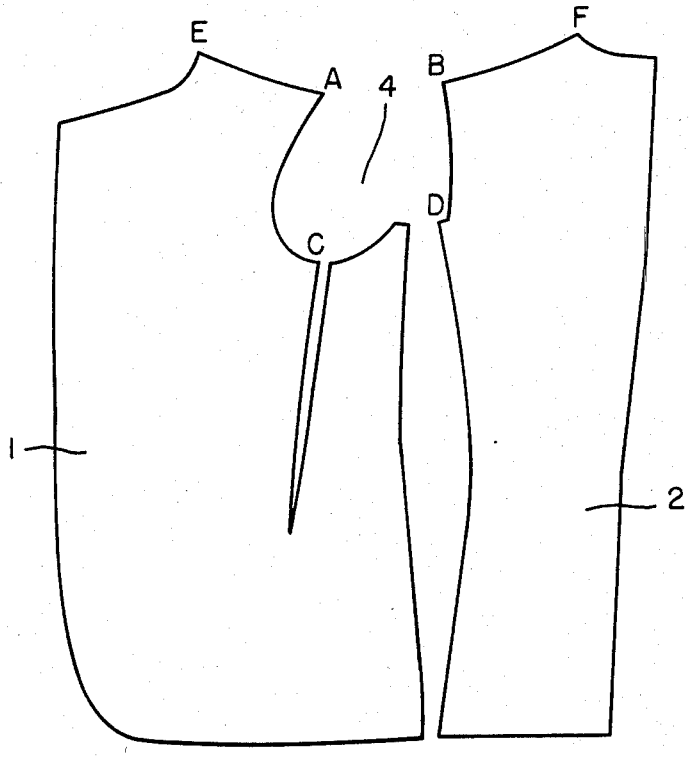
FIG. 2. PRIOR ART
Figure 3:
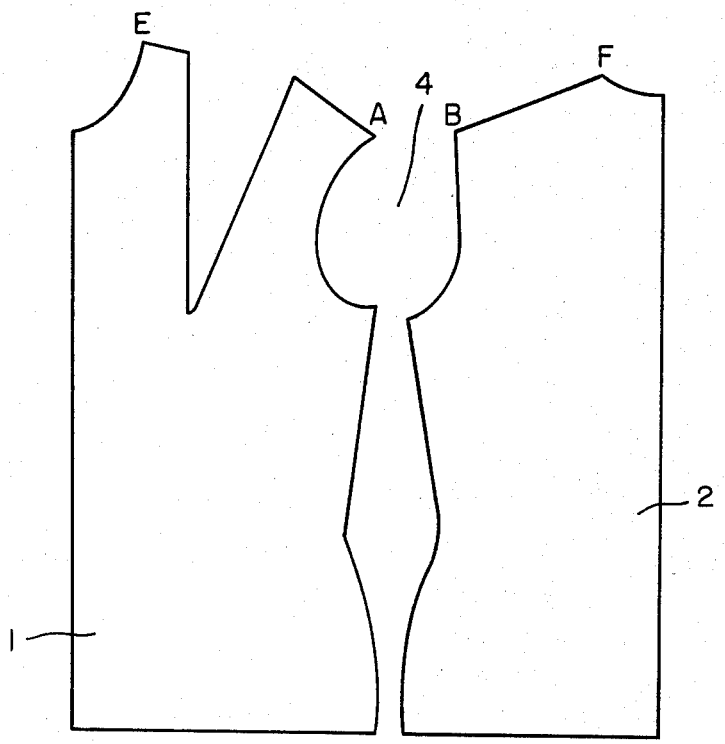
FIG. 3. PRIOR ART
Figure 4:
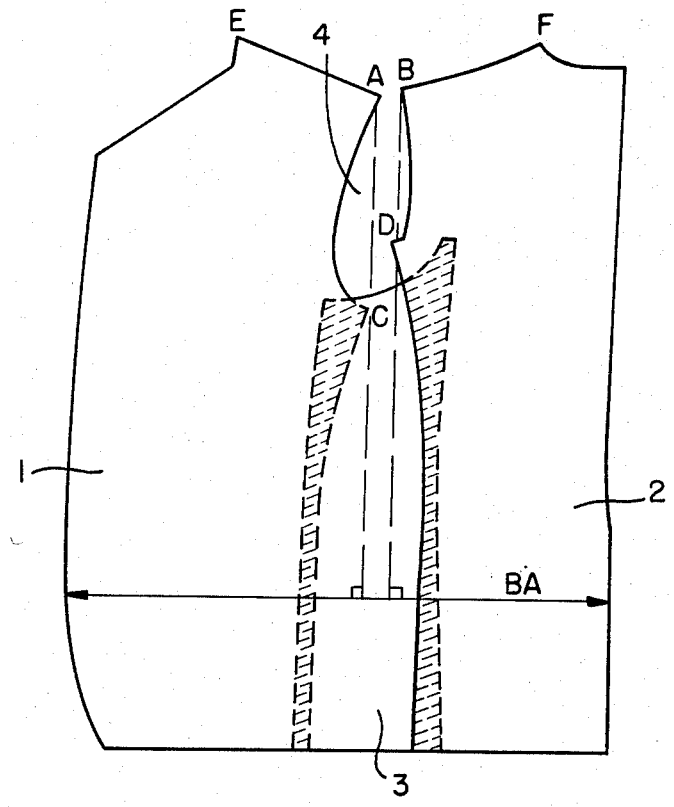
Figure 5:
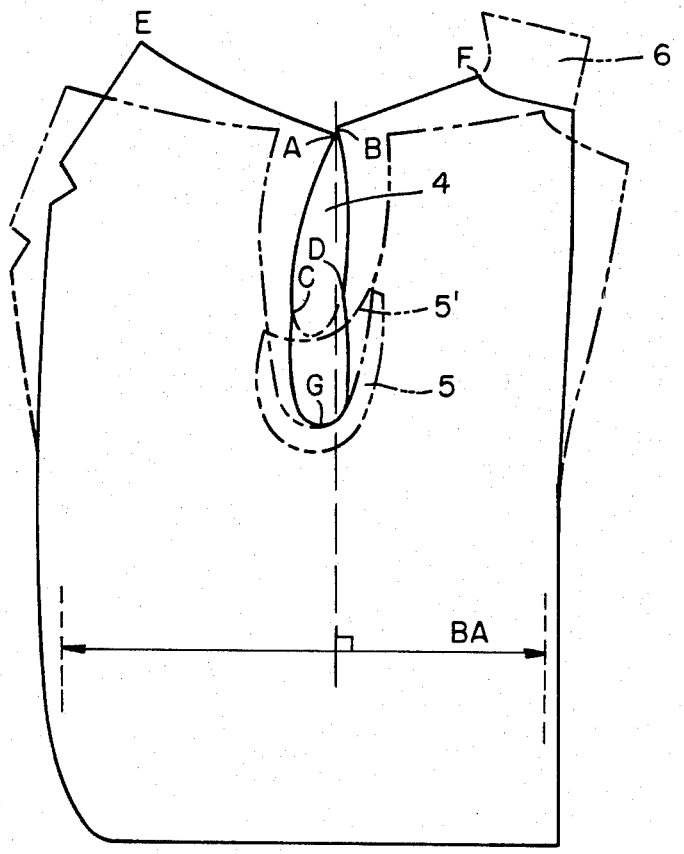
Figure 6:
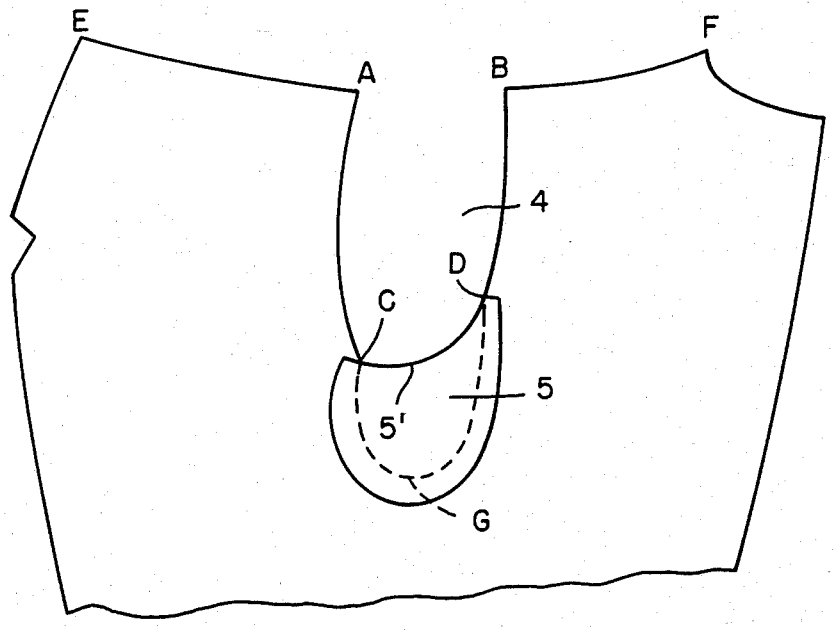
Figure 9:
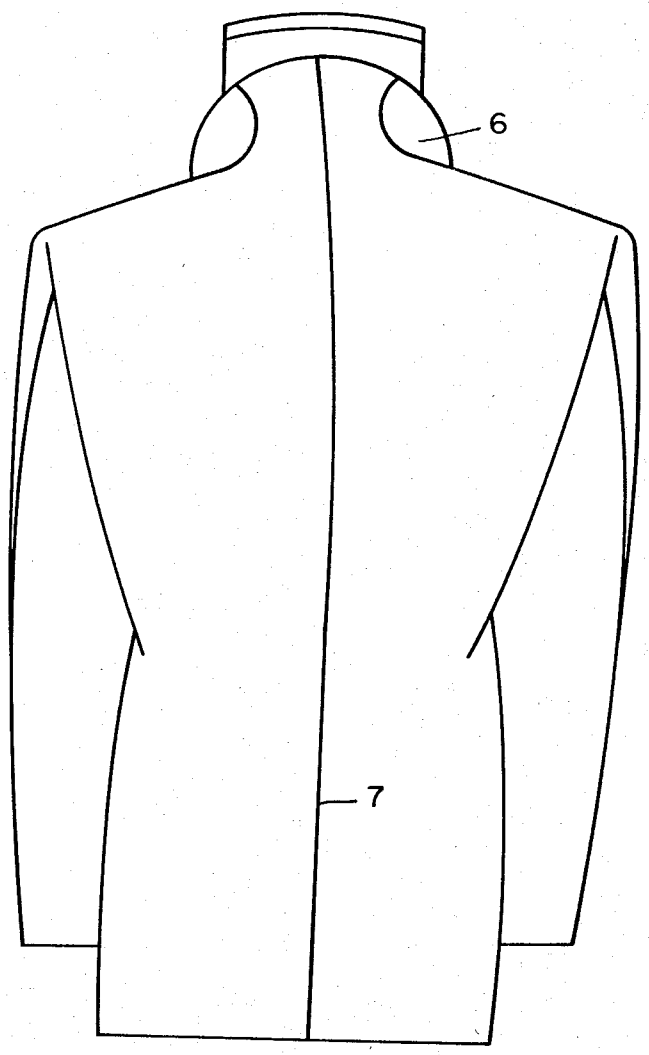
Figure 8:
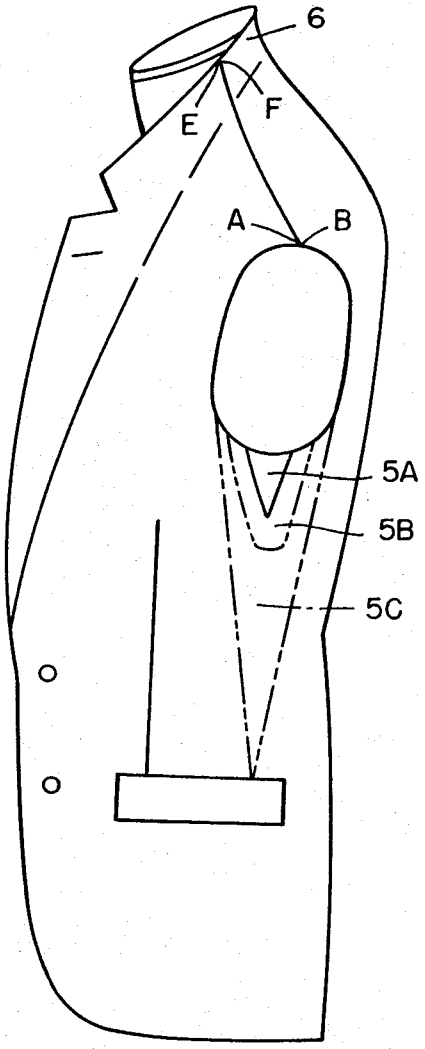
Figure 7:
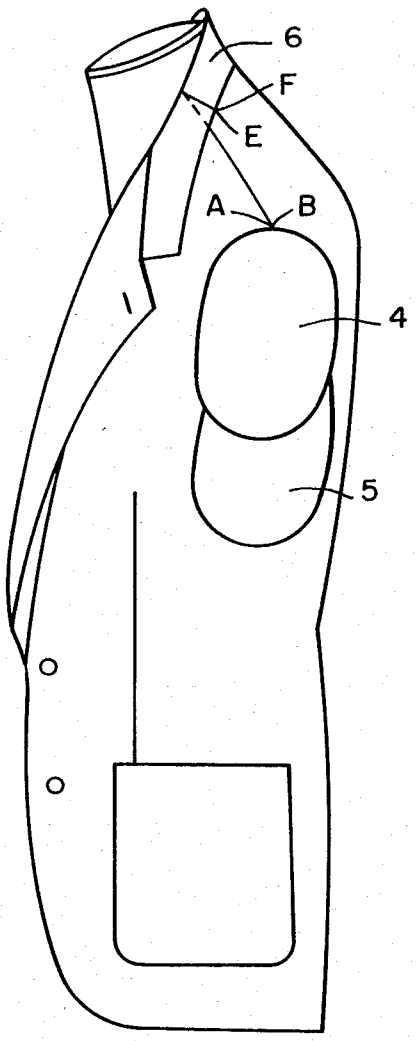
Figure 11:
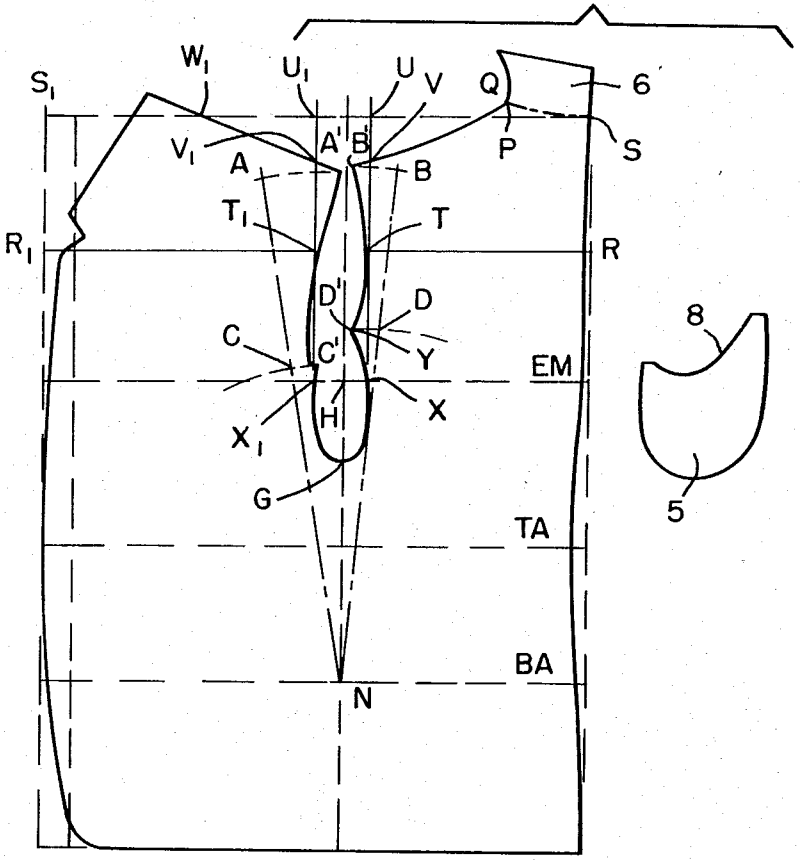
Figure 10:
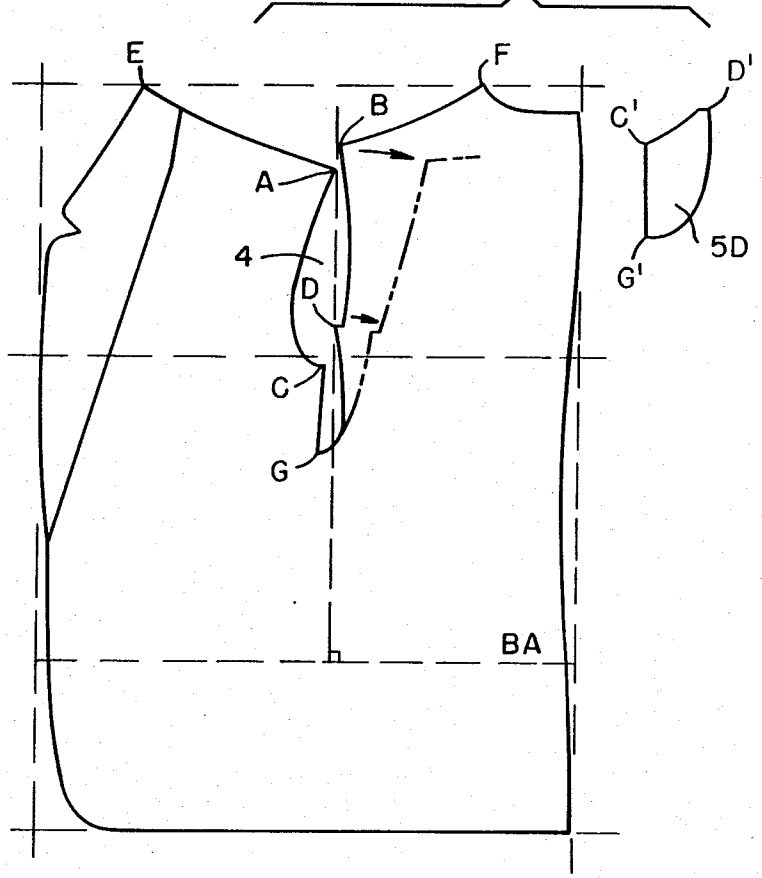
Figure 12:
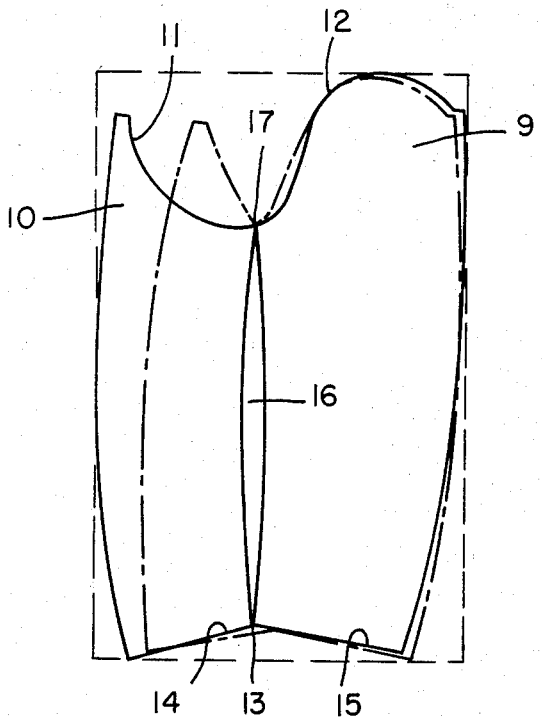
Figure 13:
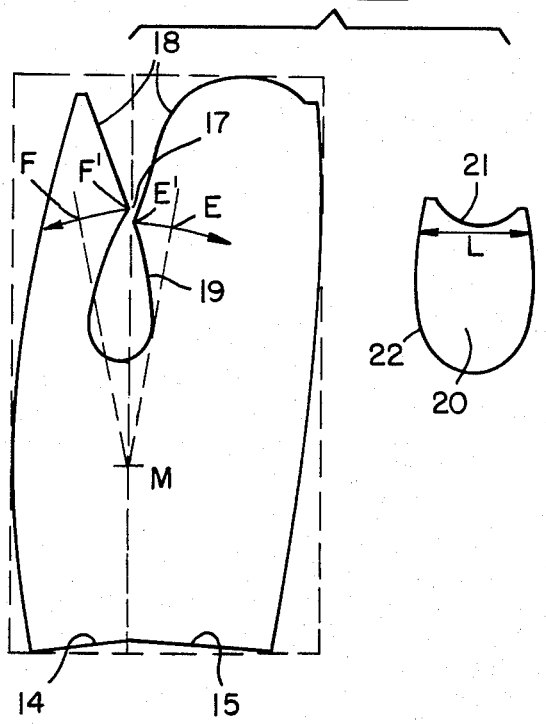

In the explanations supplied below, reference will be made to the attached drawings, in which:

FIG. 1 shows on a reduced scale of approx. 1/5 the conventional tracing of three parts which form one half of a jacket, FIGS. 2 and 3 show, respectively, on a reduced scale, conventional tracings of two parts which form one half of a garment, with FIG. 2 referring to a jacket and FIG. 3 to a dress, FIG. 4 is a composite view to explain the inventive idea on which the method of the invention is based, FIG. 5 shows on a reduced scale of approx. 1/5 the tracing of a jacket in accordance with the method of the invention, which also explains how this jacket is assembled according to the invention, FIG. 6 is a partial view which shows the jacket of FIG. 5 while it is being assembled, FIGS. 7, 8, 9 are, respectively, two side views and one rear view of a jacket assembled according to the invention, with FIGS. 8 and 9 showing two variants in the execution of the method, FIG. 10 is analogous to FIG. 5, showing another variant in the execution of the method, FIG. 11 is a sketch showing the use of a preferred tracing, cutting and assembling method according to the invention, FIG. 12 is an analogous to FIG. 4 but refers to a sleeve and demonstrates the advantages of the method of the invention for tracing, cutting and assembling that sleeve, FIG. 13 is a sketch explaining a preferred method of tracing, cutting and assembling a sleeve according to the invention.

In the description below we will consider, as is usual in cutting classes, only one half of a garment consisting of the front and of the back up to the vertical seam at the center line of the back.

FIG. 1 shows a conventional cutting pattern in three parts, consisting of front 1, back 2 and an intermediate part 3 located below armhole 4. Due to their pattern these three parts do not match. As a matter of fact, even if their pattern permits making them match, it is necessary to provide space between them so that they can be cut properly by means of the tools (band saws) used for cutting multiple layers of fabric. In addition, in order to be able to sew them together it is necessary to provide an allowance of 2 to 3 cm for the seams.

FIGS. 2 and 3 show two patterns in conventional style, without an intermediate part, which consist only of two parts, the back 1 and the front 2. FIG. 3 shows, in particular, a dress pattern. The invention can also be used for this type of garment. The same comments can be made regarding the spacing of these parts.

In the three conventional examples shown in FIGS. 1 to 3, one half of the garment is obtained by sewing together three or two parts and by closing the armhole by a seam which joins the edges AE and BF. Below we will pay special attention to the two points A and B which are the topmost points of the outline of the armhole. Pleats, which are standard or special depending on the figure of the wearer, are disregarded for purposes of this disclosure as they do not directly relate to the present invention.

It is known that among the standard measurements pertaining to the different sizes of ready-to-wear garments, the longest measurement in centimeters is the circumference of the chest, which is simply called the chest. For a waist size of 48, for example, it is general practice to make the size of the chest (or more precisely one half of the chest, as only one half of the garment is taken into consideration) equal to 54 cm (48 cm plus 5 to 7 cm for comfort) while the hips measure 51 cm. The chest measurement is always several centimeters larger than that of the hips.

If the three parts 1, 2, 3 of FIG. 1 are put close together in order to obtain at the level of the hips the length or "hip size" BA, as shown in FIG. 4, the two parts 1 and 2, the front and the back, partly cover intermediate part 3, particularly in the upper part of the garment. Further, the size of the armhole 4 is greatly reduced. The points A and B, in particular, are moved close together. While in the conventional patterns of FIGS. 1 and 2 these points A and B may be spaced about 14 to 17 cm apart, the distance between them may be reduced to as little as 2.5 to 7 cm after parts 1, 2, 3 have been placed closely together. When this occurs, the armhole is no longer of a sufficient size. In making such garments, the general practice is to make the armhole, at its widest point, of a dimension equal to one-quarter of the chest plus 2 cm. Thus, for a waist of 48 cm, the maximum armhole width would be equal to 15.5 cm.

We observe that placing parts 1, 2, and 3 close together as shown in FIG. 4 causes a considerable reduction in the area of intermediate part 3, which is indicated by shading in the figure.

The method of the invention consists of tracing and cutting one half of the garment in a single piece inside a tracing rectangle whose width is equal to the sum of the hip measurement BA (FIG. 4) and the allowances required for the back seam and for buttoning.

In accordance with the invention, points A and B (FIG. 5) on the upper edge of the armhole are located on perpendiculars to the hip line BA and are separated by a distance of between 7 cm and 0 cm. A cut-out portion is provided below the armhole, and an auxiliary part is cut and sewn to the edges of the cut-out portion in such a manner that the armhole and the distance between points A and B are enlarged to the normal, useable size.

The greatest benefit of the method of the invention is obtained if the two points A and B are located on the same perpendicular, as is shown in FIG. 5 where the hip dimension BA is extended to the right by 1 cm for the seam and to the left by 2 cm for buttoning. In this case the fabric saving is greater than shown in the shaded areas of FIG. 4, since the points A and B are closer to each other and the two seams for attaching intermediate part 3 to the front and back parts are eliminated.

According to the method of the invention, the armhole is not traced along the line A B C D, with the section C D represented by a dot-dash line in FIG. 5 as would result from the joining of points C and D in FIG. 1. Instead, the "partial armhole cut-out portion" formed by the lines A C and B D are extended by tracing an "auxiliary cut-out portion" whose lowest point is G. The resultant structure is cut along the solid line A C G D B in FIG. 5. An auxiliary fabric panel 5 is then cut separately and is sewn below points C and D to the edges of the widened auxiliary cut-out portion C G D, after points A and B have been spread apart in order to give the armhole a normal, useful outline and width as shown by the double dot-dash line in FIG. 5.

After sewing, auxiliary fabric panel 5 maintains armhole 4 in a shape and width achieved in the prior art by assembling the three parts 1, 2, 3 or the two parts 1, 2 as shown in FIGS. 1 to 3. The upper edge 5' of the auxiliary panel 5 has an outline which restores the missing portion of the outline of armhole 4 between points C and D.

FIG. 6 and FIG. 7 show, respectively, armhole 4 in a flat position after it has been reshaped with the aid of auxiliary fabric panel 5 and the same armhole 4 attached to one half of a jacket obtained by making a plain seam which joins edges AE and BF.

With the exception of its upper edge 5' which preferably restores the missing part of the armhole, the outline and the dimensions of auxiliary panel 5 are not critical in practicing the invention. When the upper part, i.e., the chest, of the garment has been traced with a width equal to that of the hips, it is necessary to give it the required size. The advantage of the invention is that it has discovered that this can be easily done if the two sides AC and BD of the armhole are spaced apart by cutting out a portion extending from the bottom of armhole 4 ("auxiliary cut-out portion") and by providing a panel 5 which is sewn to the edges of the cut-out portion thereby reestablishing the size necessary on the basis of the chest measurement.

FIG. 8 shows three different embodiments in which the present invention is practiced. The auxiliary cut-out portion made at the bottom of the armhole can be a simple straight-line incision and the auxiliary fabric panel can be a simple triangular part 5A, shown in solid lines, sewn to the edges of the auxiliary cut-out portion. Instead of being a simple cut the auxiliary cut-out portion can be widened to a triangle and panel 5B can be of basically trapezoidal shape as shown in single-dot-dash lines. The auxiliary cut-out portion can be even wider and longer and auxiliary panel 5C can have the shape of an elongated triangle extending, for instance, down to the pocket of the jacket, as shown in double-dot-dash lines.

Naturally, the larger the auxiliary cut-out portion is made until it becomes a type of opening, the larger auxiliary panel 5 will become and the advantage achieved by the invention in terms of fabric savings and shortening of the seams will be reduced.

We should mention that a simple incision and a simple triangular auxiliary panel 5A, which offer the greatest fabric saving and the greatest reduction in the length of the seam, are generally not preferred because of the difficulty of making the seam.

A rounded panel 5, together with an auxiliary cut-out portion with a curved outline C G D, as shown in FIG. 5, result in stitching along a continuous curve with a comparatively large radius. This design is preferred because of ease of execution, although it does not offer the greatest saving of fabric.

It follows from the above that the outline of the auxiliary cut-out portion and that of the auxiliary panel are closely related, as the latter must cover the auxiliary cut-out portion and spread it to the required width. So far, panels 5, 5A, 5B, 5C have been described as symmetrical or almost symmetrical in relation to an axis passing through the center of the armhole.

FIG. 10 shows that a completely nonsymmetrical panel 5D can be used. FIG. 10 shows the usual parts AC and BD of armhole 4. In accordance with the method of the invention, the points A and B on the upper part of armhole 4 are located on the same perpendicular to the hip line BA. A straight cut perpendicular to the line BA was made from point C to point G and said point G was joined with point D by curved concave line located on the side of the straight line CG. Auxiliary panel 5D has a corresponding outline with a straight segment C'G' and a curved segment G'D'. A dot-dash line shows how auxiliary cut-out portion CGD is opened to separate point B from point A. In this case only part of the back of the garment is moved by folding it around point G, as indicated by the arrows. It is also possible to use the inverse method and use an auxiliary cut-out portion and an added part which would cause only the front of the garment to be moved.

We can see that the invention gives a wide choice in the method used for obtaining the required enlargement of armhole 4. Only two conditions have to be complied with. It is desirable that the upper edge (edge CD of panel 5 in FIG. 6 or C'D' of panel 5D in FIG. 10) have an outline which suitably restores the missing portion which corresponds to the usual outline of the armhole. On the other hand, as has been stated above, it is the purpose of the auxiliary cut-out portion and the auxiliary panel to ensure the usual distance of approximately 15.5 cm between points A and B which gives armhole 4 its appropriate size. In the case of FIGS. 5 and 10, for example, it has been found that it is sufficient to space points C and D approximately 4.5 cm apart by means of a pivoting movement in order to assure that the points A and B are separated by the required distance of 15.5 cm.

These figures are given as indications only, as they may differ for different waist sizes, types of garment, the figure of the wearer, but they are frequently correct. In other words, the auxiliary panels 5 and 5A to 5D should result in an additional spreding of the auxiliary cut-out portion by a distance of approximately 4.5 cm, regardless of how their outline is otherwise shaped.

The method of the invention also makes it possible to produce a collar which is an integral part of the one-half of the jacket. The tracing of such a collar 6 is shown in FIG. 5 by a triple-dot-dash line and the same collar 6 is shown in FIGS. 7 and 8 in the turned-down and turned-up position. FIG. 9 shows a collar 6 from the back, in the turned-up position, as a single piece with the two halves of the garment which are joined by a back seam 7.

A preferred way to practice the method of the invention will now be described in greater detail with the aid of FIG. 11.

A rectangle is traced with a width equal to the hip line BA plus the stitching supplement for the back and the stitching supplement (3 cm) for buttoning the front. The height of this rectangle is, as usual, equal to the desired length of the garment measured from the base of the collar. According to the invention, the upper part of the garment, which includes the armhole, is traced on the basis of dimensions which are either determined by measurement or based on empirical values known per se. By the use of empirical values the usual outline of the upper part of the garment is obtained and the use of measured values, in accordance with the invention, places this upper part and the top of the armhole inside the rectangle, traced with the hip size as a base.

The hip line BA and the bottom line EM of the armhole are drawn in accordance with the measured values. From the top point S of the line on the right, the center line of the back of the garment, the distance SP equal to 1/6 of the chest is measured off on the top side of the rectangle, then the distance PQ equal to 1/24 of the chest is measured off on a perpendicular; this gives the point Q outside the rectangle. If a collar is included, it is traced above the line QS. If no collar is included, the concave line QS (shown as a dot-dash line) is drawn.

From the midpoint R of the distance between top point S and the bottom line EM of the armhole, the parallel RT is drawn whose length is equal to one half of the measured shoulder width of the back plus 1 cm. From T a straight perpendicular is drawn to the top side of the rectangle, which intersects this side at U. From point U the distance UV equal to 2.6 cm (a value which has been empirically determined as being the height of the shoulder in the back) is measured off, inside the rectangle, on said straight perpendicular line. Then the line QV is drawn which is extended by 1 cm (an empirical value) beyond V. This gives us point B'.

On the same line RT, but from point R1 on the left side of the rectangle, the distance R1T1 is measured off, which is equal to the shoulder width in front plus 1 cm, plug 3 cm as buttoning allowance for the front. Point T1 is thus obtained from which is drawn a straight perpendicular to the top side of the rectangle, which it intersects at U1. From U1 the distance U1V1 equal to 5 cm (a value which has been empirically determined as being the height of the shoulder in front) is measured off inside the rectangle. On the top side of the rectangle an empirical distance of 10 cm plus the buttoning allowance is measured off from the left top point S1 and point W1 is obtained. Now the line W1V1 is drawn which is extended by 1 cm (empirical value) beyond V1. This gives us point A'.

The perpendicular UT intersects the armhole bottom line EM at point X. From this point toward point T, the distance XY equal to 4 cm (empirical value) is measured off and point Y is obtained. From point Y, a line parallel to line EM is drawn on which a distance of 1 cm (empirical value) is measured off toward the front of the garment. The point D' is thus obtained.

We proceed in the same manner from point X1 which is the intersection of U1T1 with the line EM by first measuring off a distance of 2 cm from X1 toward the top and then a distance of 1 cm toward the back. Point C' is thus obtained.

The points C' and D' are the bottom points of the partial armhole outline and the points A' and B' are the top points.

We then trace with a French curve the curved line B'TD' and the curved line A'T1C'. These curves represent part of the armhole outline in the front and the back of the garment.

If the above procedure is followed, we find that the points A' and B' are close to each other. Depending on the size of the shoulder width and on the location of the bottom of the armhole on the wearer, and depending also on the empirical values, particularly those of the shoulder height, which may be modified depending on the style and the individual wearer, the points A' and B' are either located on the same perpendicular to the line EM or on two distinct perpendiculars which are not more than 7 cm apart.

As the distance between points A' and B' in FIG. 11 is small, one single equidistant straight perpendicular to the lines EM and BA has been drawn, which intersects line BA at point N.

Below the points C'D' an open slit with a rounded outline C'GD' has been drawn which permits easy stitching along a continuous curved line.

The outline of auxiliary panel 5 is drawn separately; it has a top edge 8 which is curved inward in such a way that it replaces the missing armhole outline between the points C', D' after these points have been spread apart. This edge 8 must pass through point H where the perpendicular which is equidistant between A' and B' intersects line EM.

Panel 5 is made sufficiently wide to spread slit C'GD' in the following manner. With point N as center of rotation, point D' is made to pivot the right as far as D, over a distance D'D of approximately 2 cm, and point C' is made to pivot to the left as far as C over a distance of approximately 2.5 cm. After cutting, panel 5 is sewn to the edges of slit C'GD' to keep the points C'D' in the spread-apart position C, D. Consequently the points A' and B' will also be spread apart by pivoting and will be located at A and B, their usual positions.

If desired, it is also possible to trace collar 6 which will form an integral part of that one-half of the garment. The outline of collar 6 and the outline of the edge of the garment and of the edge of the armhole which determine the points A', B', C', D' are determined by the measurements and the conventional rules to which the invention does not relate.

It was a surprising observation that a garment which is cut and sewn in two main parts and are joined only by one seam in the back (FIG. 9), incorporating a collar 6 if desired, and with two auxiliary panels 5 under the arms, fit the wearer very well and is easier to adjust by means of the usual pleats than garments cut in the conventional manner.

The method of the invention also applies to the production of sleeves for garments. Garment bodies consist conventionally of two parts, front 1 and back 2, as shown in FIGS. 2 and 3, defining an armhole outline A C D B; in the same manner, a conventional sleeve (FIG. 12) consists of two separate parts: part 9 which forms the outer side of the sleeve and part 10 which forms the inner side. These parts 9, 10 each have a top edge 11, 12, respectively, each of which is given an outline adapted to that of armhole 4 of a jacket with a contour as shown in FIG. 7. By bringing the two conventional parts 9, 10 as close to each other as possible without causing them to overlap, they can be inscribed in a rectangle drawn in FIG. 12, where the two parts are drawn in solid lines. If the two parts 9, 10 are brought closer to each other, in the same manner as this has been done for the jacket parts, by having them touch each other by one end 13 of their respective bottom edges 14, 15 and by making them pivot around said point 13 so that the space 16 between them disappears, we observe that the rectangle containing them can become much narrower. In FIG. 12 the two parts which have been brought closer to each other without space in-between are shown by dot-and-dash lines and shifted to prevent superimposition of the lines. They now partly cover each other and form a new part 16 without seam. The top edges 11, 12 now intersect at point 17.

The part 16 is drawn in a solid line in FIG. 13, inside a rectangle which may have a width of only 30 cm and a height of 72 cm (which is equal to the length of the sleeve). The dimension of the lower edge 14, 15 of this single piece 16 forming the sleeve is the usual one for the lower end of a sleeve, but the upper part is no longer wide enough because the upper edge 18 is now only part of the outline of the armhole.

According to the invention, an auxiliary cut-out portion 19 is traced and cut from the point of intersection 17 of the former edges 11, 12. This auxiliary cut-out portion is then opened in order to spread apart the two upper portions and to reconstitute the outline of the edges 11, 12. Preferably, one draws through point 17 a perpendicular to the small side of the former inscribed rectangle, and a point M approximately one-third from the lower end of the sleeve is selected. With point M as a pivot, auxiliary cut-out portion 19 is opened in such a manner that point E' is shifted to the right (to E) from a location close to the point of intersection 17. Similarly, point F' is shifted to the left (to F) from a location close to the point of intersection 17. The points E and F are held apart by means of auxiliary fabric panel 20 which is cut separately. Width L of panel 20 is equal to ¼ of the hip size. Its upper edge 21 is traced in such a way that it replaces the missing outline of the armhole between the separated points E and F. The balance 22 of its outline and the shape of auxiliary cut-out portion 19 are chosen in such a manner that it is easy to make a seam along a continuous curve. The value L is based on empirical experience; it can be changed.

It will be apparent to those skilled in the art that the same method is applied to each sleeve which is used for the two halves of the body of the garment.

It should now be appreciated that the method of the invention can be generally described as follows:

A main panel is prepared which has an outline of an armhole. An auxiliary cut-out portion is provided in the lower part of the reduced outline of the armhole. The auxiliary cut-out portion is opened and held open by means of an auxiliary panel which is sewn to the edges of the opened portion of the main panel in order to provide a completed armhole with a useful width.

The method of the invention has the disadvantage that is uses an auxiliary panel which remains visible under the arm of the garment. This panel can be reduced to the smallest size required, as has been explained. In addition, this panel is only visible when the arm or the sleeve is lifted. Thus, the disadvantage is insignificant and is largely compensated for by the advantages related to the saving of fabric and the reduction in sewing time, particularly if the garments are those for everyday use such as children's wear, work clothes, uniforms, leisure wear, etc.

I claim:

1. A method for constructing fabric panels for use in garments having armholes comprising the steps of:

providing fabric from which a main panel forming one half of a garment is to be constructed, said main panel having an upper chest portion containing an armhole area and a lower waist portion having a width determined by the hip size of a garment to be constructed;

defining a rectangular area on said fabric, the width of the rectangle being equal to the sum of the width determined for said lower waist portion plus an allowance for a back seam and an allowance for buttoning the garment;

cutting said main panel from within said rectangular area in accordance with a predetermined pattern, said pattern including a narrow partial armhole cut-out portion of insufficient width to form a useful armhole and an auxiliary cut-out portion extending from the bottom of said partial armhole cut-out portion;

spreading the edges of said partial armhole cut-out portion apart to enlarge the width thereof to a useful size;

providing an auxiliary fabric panel having an upper edge shaped to form the bottom of a useful armhole, and sewing or otherwise fixing said auxiliary fabric panel to said main panel to cover said auxiliary cut-out portion with the upper edge of said auxiliary fabric panel cooperating with the spread edges of said partial armhole cut-out portion to maintain said edges in said spread condition and form a completed armhole cut-out portion.

2. The method of claim 1 wherein said partial armhole and auxiliary cut-out portions form an elongated U shape and the tips of the U are spaced a distance of from 0 to 7 centimeters from each other before they are spread apart.

3. The method of claim 1 wherein said auxiliary cut-out portion is in the shape of a continuous curve to facilitate the sewing of said auxiliary fabric panel along the edges thereof.

4. The method of claim 1 wherein the bottom edges of said partial armhole cut-out portion are spread apart during said spreading step an additional distance of approximately 4.5 centimeters.

5. A method for constructing a sleeve for a sleeve garment comprising the steps of:

providing fabric from which a sleeve is to be constructed;

defining a rectangular area on said fabric;

cutting a sleeve panel from within said rectangular area in accordance with a predetermined pattern, said pattern including (1) a substantially V-shaped partial armhole outline having a perimeter which is too short to attach around an armhole in a corresponding sleeved garment, and (2) an auxiliary cut-out portion extending from the bottom of said partial armhole outline;

spreading the edges of said partial armhole outline apart;

providing an auxiliary fabric panel having an upper edge shaped to complete said partial armhole outline; and sewing or otherwise fixing said auxiliary fabric panel to said sleeve panel to cover said auxiliary cut-out portion with said upper edge cooperating with the spread edges of said partial armhole outline to maintain said edges in said spread condition and form a complete armhole outline for attachment to an armhole on a garment.

6. The method of claim 5 wherein the width of said auxiliary fabric panel is approximately one-fourth of the hip size of a garment for which the sleeve is intended.

* * * * *